US005219501A

United States Patent [19]

Yoon et al.

[11] Patent Number: 5,219,501

[45] Date of Patent: Jun. 15, 1993

[54] PROCESS FOR THE PRODUCTION OF ACRYLIC SHORT FIBERS WITHOUT SPINNING

[75] Inventors: Han S. Yoon; Tae W. Son; Chul J. Lee; Byung G. Min, all of Seoul; Jae W. Cho, Kyongido, all of Rep. of Korea

[73] Assignee: Korea Institute of Science and Technology, Seoul, Rep. of Korea

[21] Appl. No.: 723,187

[22] Filed: Jun. 28, 1991

[30] Foreign Application Priority Data

Jul. 11, 1990 [KR] Rep. of Korea ..... 90-10459[U]

[51] Int. Cl.[5] ..... D01F 6/18

[52] U.S. Cl. ..... 264/85; 264/143; 264/206; 264/210.4; 264/210.6; 264/210.8; 264/211.17

[58] Field of Search ..... 264/85, 143, 206, 210.4, 264/210.6, 210.8, 211.14, 211.17

[56] References Cited

U.S. PATENT DOCUMENTS

| | | | |
|---|---|---|---|
| 2,417,294 | 3/1947 | D'Alelio | 264/206 X |
| 3,402,231 | 9/1968 | Bynum et al. . | |
| 3,984,601 | 10/1976 | Blickenstaff | 264/206 X |
| 4,163,770 | 8/1979 | Porosoff | 264/206 X |
| 4,650,624 | 3/1987 | Reinehr et al. | 264/143 |

FOREIGN PATENT DOCUMENTS

| | | |
|---|---|---|
| 55-41328 | 10/1980 | Japan . |
| 62-149908 | 7/1987 | Japan . |

OTHER PUBLICATIONS

Bruce G. Frushour, "A New Thermal Analytical Technique for Acrylic Polymers," Polymer Bulletin 4, pp. 305–314 (1981).

*Primary Examiner*—Leo B. Tentoni

*Attorney, Agent, or Firm*—Oblon, Spivak, McClelland, Maier & Neustadt

[57] ABSTRACT

A process for the production of pulp-like short fibers having a highly-oriented fibril structure without spinning is provided. This process comprises heating a mixture of water and an acrylonitrile homopolymer or copolymer to a temperature above the melting temperature of the mixture under enclosed conditions to form an amorphous melt; cooling the resulting amorphous melt to a temperature below the melting temperature to obtain a supercooled melt phase; extruding the resulting supercooled melt phase through a slit die at a temperature between the melting and the solidifying temperatures of the melt phase into an external atmosphere to give extrudates; and subjecting the resulting extrudates to drawing and heat treatment followed by beating mechanically.

13 Claims, 11 Drawing Sheets

PROCESS FOR THE PRODUCTION OF ACRYLIC SHORT FIBERS WITHOUT SPINNING

BACKGROUND OF THE INVENTION

1. Field of the Invention

The present invention relates to a novel process for the production of pulp-like short fibers having a high degree of orientation from an acrylonitrile polymer (hereinafter, referred to as "PAN") without a spinning process.

2. Description of the Prior Art

It is well known that molecular chains of PAN are twisted into an irregular helix due to the strong polarity of nitrile groups in the side chains thereof and have characteristics closely allied to rigid chains. See W. R. Krigbaum et al., Journal of Polymer, Volume XLIII, pp 467–488, 1960. If to such polymers is added a strong polar solvent, such as dimethylformamide, dimethylacetamide, dimethylsulfoxide, or an aqueous NaSCN solution, an aqueous $ZnCl_2$ solution or an aqueous $HNO_3$ solution, the nitrile groups attract the molecules of these solvents to combine therewith: thereby, the groups are separated from each other to form a fluid solution, even at room temperature.

A few processes for the production of fibers taking advantages of PAN's properties mentioned above, which comprise spinning a mixed solution of PAN in a solvent through microholes provided in a spinning die, have been known. According to these processes, if the solvent is removed after extruding the fluid solution, PAN is solidified to take into the form of a fiber.

Therefore, the resulting filaments are deemed to be present in the form of a fiber immediately after spinning. However, if the solvent is removed and then the filaments are dried, the PAN molecular chains in the filaments are reconglomerated to form a non-oriented lump after all since the internal molecular chains in the resulting filaments have not been oriented at all. Accordingly, in order to obtain a complete fibrous structure from the viewpoint of the molecular construction, it is necessary to draw the resulting filaments in a high draw ratio of above 5 to 30 so that the molecular chains are arranged in parallel with the axis of the fiber. As the filaments are drawn, the non-oriented, conglomerated PAN molecular chains are become disentangled and extended out while arranging with each other, and thereby form fibers having an extended chain crystal region. Therefore, the drawing process is indispensible in the prior art processes for producing fibers, and the substantial fiber structure, in which most molecular chains are oriented in parallel with the fiber axis, can not be obtained until the resulting filaments are subjected to a drawing process.

However, such prior art processes using a solvent have suffered from the defects that they cost a great deal in extracting, recoverying and purifying solvent and an environmental pollution may be caused due to the use of solvent.

In order to solve such problems encountered in the prior art, various processes which comprise forming a melt by heating a mixture of PAN and water followed by spinning and drawing the resulting melt to produce fibers have been proposed. For example, U.S. Pat. No. 2,585,444 teaches that PAN fibers can be produced by heating PAN hydrate containing 30% to 85% by weight of water to above its melting temperature to give a melted fluid followed by melt spinning the resulting fluid. U.S. Pat. Nos. 3,896,204 and 3,984,601 disclose processes for the production of fibers which comprises heating a mixture of PAN and water of about 20% to 30% by weight to a temperature ranging from 170° C. to 205° C. to give an amorphous melt, and spinning the resulting melt followed by drawing by above 5-folds to form fibers. U.S. Pat. Nos. 3,991,153 and 4,163,770 disclose processes for the production of fibers which comprises spinning PAN hydrate containing 10% to 40% by weight of water at above its melting temperature, that is, a temperature range in which an amorphous, single phase melt of the hydrate is formed, and then drawing the extruded filaments in a 25 to 150-folds draw ratio in a pressure chamber to give fibers. However, according to the prior art processes mentioned above, fibers in which PAN molecular chains are oriented cannot be produced until the resulting filaments are drawn in a high draw ratio, since the spinning step is carried out at a temperature in which the PAN hydrate can exist in the form of a disordered, amorphous melt.

U.S. Pat. Nos. 3,402,231; 3,774,387; and 3,873,508 also disclose processes for the production of fibers for pulp, which comprises heating a mixture of PAN with water of above 100% at about 200° C. to form a melt, and then spinning the resulting melt to produce fibers. However, since in these patents an excess of water is used and the melt of PAN is obtained at a high temperature, the resulting PAN/$H_2O$ melt takes a random, amorphous form and PAN filaments extruded therefrom also are no more than a non-oriented, continuous foam which practically have neither the orientation of the molecular chains nor the fibrous structure, although they appear to be formed into the form of a fiber externally.

As described above, according to the conventional melt spinning techniques, fibrous structures could not be obtained until the resulting filaments are drawn in a high draw ratio, for example, a 5 to 30-folds draw ratio.

SUMMARY OF THE INVENTION

Considering the prior art techniques, the inventors have intensively studied on the two-component system comprising PAN and water (hereinafter, referred to as the "PAN/$H_2O$ system") and have found unexpectedly that the "PAN/$H_2O$ system absorbs heats of fusion to form a melt of an amorphous, single phase at the melting temperature of the PAN/$H_2O$ system. The single phase melt, even if cooled to below its melting temperature, maintains its supercooled, melted state without being crystallized until the cooling temperature exists in the range of the selected temperature (OR). When further cooled to below a solidifying temperature(Tc), PAN crystallizes and then is returned to the original state. However, when cooled to form the supercooled state, the PAN/$H_2O$ melt forms a kind of metacrystalline phase having a molecular order as it is in a single phase, unlike the amorphous melt formed at a high temperature. The physical properties of the metacrystalline phase are similar to those of a liquid crystal. This metacrystalline phase is very easy to form the molecular orientation by extrusion, as shown in FIG. 4, which will be explained later.

It appears that in the supercooled melt having the melted metacrystalline phase, PAN molecular chains, together with water molecules, form numerous, fine units of a regular phase having a molecular structure of an ordered chain form. PAN molecular chains in the melted metacrystalline phase have a self-oriented property. Thus, if some orienting-shear agents are applied to the PAN molecular chains by mechanical extrusion operation, the PAN molecules easily form a highly-oriented fiber structure. In other words, if the melted metacrystalline phase is extruded, the extended PAN molecular chains approach transversely with each other, while water contained in the system is automatically expelled off, so that the fiber structure is formed and highly-oriented fibers can be formed without a separate drawing process in a high draw ratio.

Pulp-like short fibers having the high molecular orientation produced by a process according to the present invention are very suitable for a material of clothings as well as an industrial material such as a substitute fiber for asbestos, a heat insulating and resisting fiber, a cement reinforcing fiber, and the like.

The primary object of the present invention is therefore to provide a process for the production of highly-oriented acrylic short fibers without spinning, characterized in that acrylic short fibers having a fiber structure of high molecular orientation is produced without spinning and/or drawing in a high draw ratio which are the indispensible steps in the prior art processes.

Another object of the invention is to provide a process for the production of pulp-like short fibers, characterized in that complicated steps essentially required in the conventional processes for the production of pulp-like short fibers, such as steps of preparing a stock solution wherein PAN is dissolved in a solvent, spinning the solution and solidifying the spun product, removing and recovering the solvent, drawing and fibrillating the resulting fiber, are simplified.

These and other objects of the present invention will become apparent by referring to the illustration in the drawings and the following detailed description of the invention.

DETAILED DESCRIPTION OF THE INVENTION

Figure 1A:
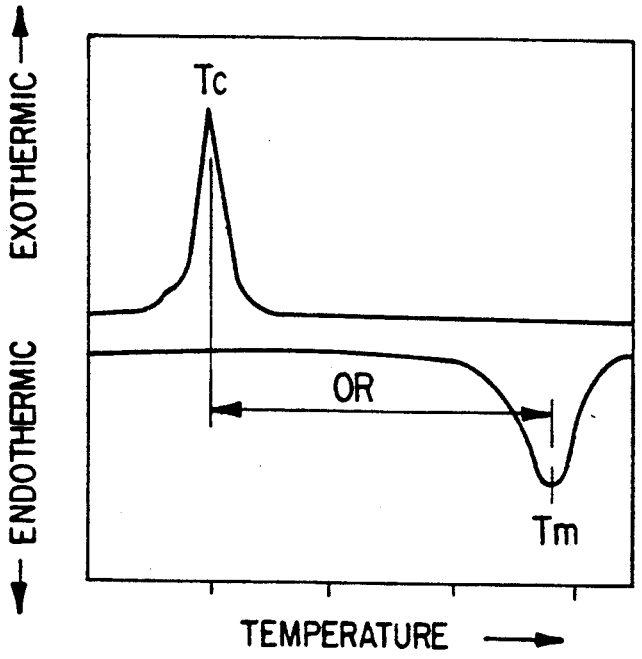
FIG. 1A illustrates typical melting endothermic and solidifying exothermic peaks derived from differential scanning calorimetry (DSC), which indicates a temperature range (OR) in which a melt of the metacrystalline phase having a molecular order can be formed resides between the melting and the solidifying temperatures.

According to the present invention, pulp-like short fibers are produced by heating a mixture of PAN consisting of acrylonitrile of above 70% by weight and a copolymerizable monomer of below 30% by weight and having a viscosity average molecular weight of 10,000 to 600,000, a water content of 5% to 100% by weight based on the acrylonitrile polymer in a hermetically sealed container to form an amorphous PAN/$H_2O$ melt; cooling the resulting amorphous melt to form a supercooled melt of the melted metacrystalline phase having characteristics similar to those of a liquid crystal and a molecular order at a temperature between a melting temperature of the PAN/$H_2O$ mixture and a solidifying temperature of the melt; extruding the resulting supercooled melt through an extrusion die having a proper size to give highly-oriented extrudates, in which platen fibrils are laminated in such a manner that the dehydration space is retained between the platen fibrils, by spontaneous discharge of water and solidification of the resulting extrudates, while a fiber structure is being formed; and heat treating the resulting extrudates to enhance the orientation thereof followed by cutting and beating the heat treated extrudates into an appropriate size to give pulp-like short fibers.

The term "PAN" as used herein refers to both homopolymers of acrylonitrile and copolymers of acrylonitrile with one or two or more copolymerizable monomers. Such copolymers should contain at least 70%, preferably above 85% by weight of acrylonitrile and at most 30%, preferably below 15% by weight of the copolymerizable monomer.

Such copolymerizable monomers include addition polymerizable monomers containing an ethylenically double bond, such as methyl acrylate, methy methacrylate, ethyl acrylate, chloroacrylic acid, ethyl methacrylate, acrylic acid, methacrylic acid, acrylamide, methacrylamide, butyl acrylate, methacrylonitrile, butyl methacrylate, vinyl acetate, vinyl chloride, vinyl bromide, vinyl fluoride, vinylidene chloride, vinylidene bromide, allyl chloride, methyl vinyl ketone, vinyl formate, vinyl chloroacetate, vinyl propionate, styrene, vinyl stearate, vinyl benzoate, vinyl pyrrolidone, vinyl piperidine, 4-vinyl pyridine, 2-vinyl pyridine, N-vinyl phthalimide, N-vinyl succinimide, methyl malonate, N-vinyl carbazol, methyl vinyl ether, itaconic acid, vinylsulfonic acid, styrenesulfonic acid, allylsulfonic acid, methallylsulfonic acid, vinyl furan, 2-methyl-5-vinyl pyridine, binaphthalene, itaconic ester, chlorostyrene, vinylsulfonate salt, styrenesulfonate salt, allylsulfonate salt, methallylsulfonate salt, vinylidene fluoride, 1-chloro-2-bromoethylene, $\alpha$-methylstyrene, ethylene and propylene, and the like.

The molecular weight of PAN is given as a viscosity average molecular weight (Mv) from an intrinsic viscosity ($\eta$) determined in an N,N-dimethylformamide solution according to the following equation:

$$[\eta]=3.35\times10^{-4}Mv^{0.72}$$

wherein the intrinsic viscosity [$\eta$] is determined at 30° C. in a solution of PAN in N,N-dimethylformamide as a solvent; see T. Shibukawa et al., Journal of Polymer Science, Part A-1, Vol. 6, P. P. 147-159, 1968.

A molecular weight of acrylonitrile polymers used in the present invention ranges between 10,000 and 600,000, preferably from 50,000 to 350,000, as a viscosity average molecular weight calculated from the intrinsic viscosity of PAN.

Figure 2A:
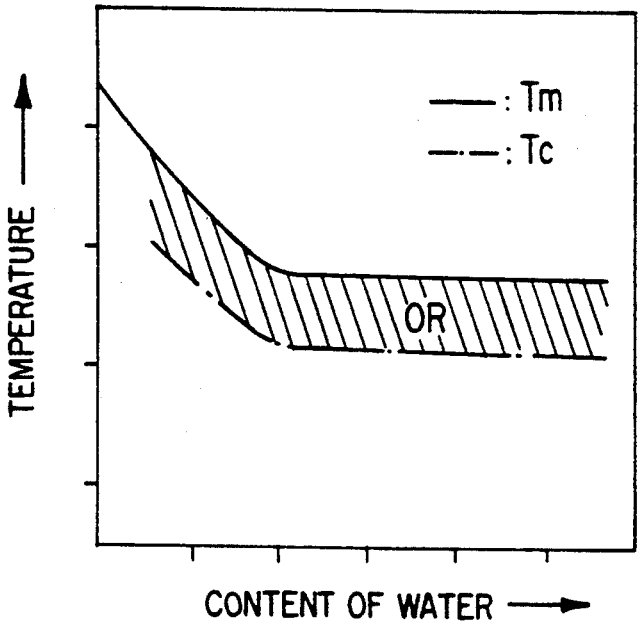
FIG. 2A is a graph illustrating typical changes in the melting and the solidifying temperatures of an acrylonitrile polymer hydrate, depending on the water content, from which it can be seen that the temperature region in which the melted metacrystalline phase having a molecular order characteristic which are similar to those of a liquid crystal is formed.

Determination of phase changes by differential scanning calorimetry, depending on the water content in hydrate, temperature and PAN composition, can provide useful information on the existence of the temperature region in which the melted metacrystalline phase can be formed, as illustrated in FIGS. 1A and 2A. In the meantime, a two component system consisting of PAN and water begins to change its phase at higher temperature than the boiling point of water under the normal pressure. It is therefore possible to obtain the melting endothermic and the solidifying exothermic peaks when elevating the temperature and cooling, respectively, using a large-volume, pressure resisting capsule which is perfectly sealed and is capable of withstanding under high pressure (Perkin-Elmer part 319-0128). As indicated in FIG. 1A, when the apexes of the endothermic and the exothermic peaks indicate the melting temperature (Tm) and the solidifying temperature(Tc), respectively, the temperature range between the melting and the solidifying temperatures corresponds to the temperature region in which a melted metacrystalline phase is formed.

Figure 1B:
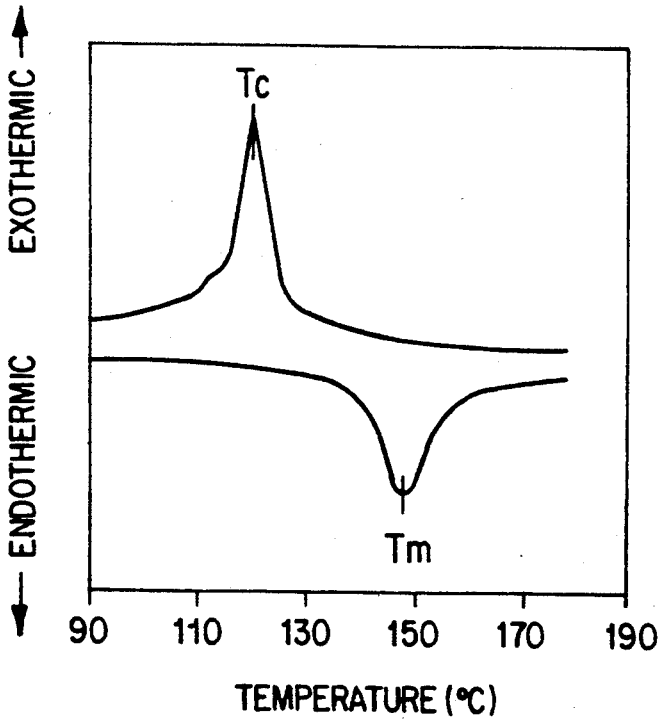
FIG. 1B illustrates an embodiment as shown in FIG. 1A, which shows the melting endothermic and the solidifying exothermic peaks of PAN hydrate which is a mixture of an acrylonitrile polymer containing 89.2% by weight of acrylonitrile and 10.8% by weight of methylacrylate, and 20% by weight of water.
Figure 2B:
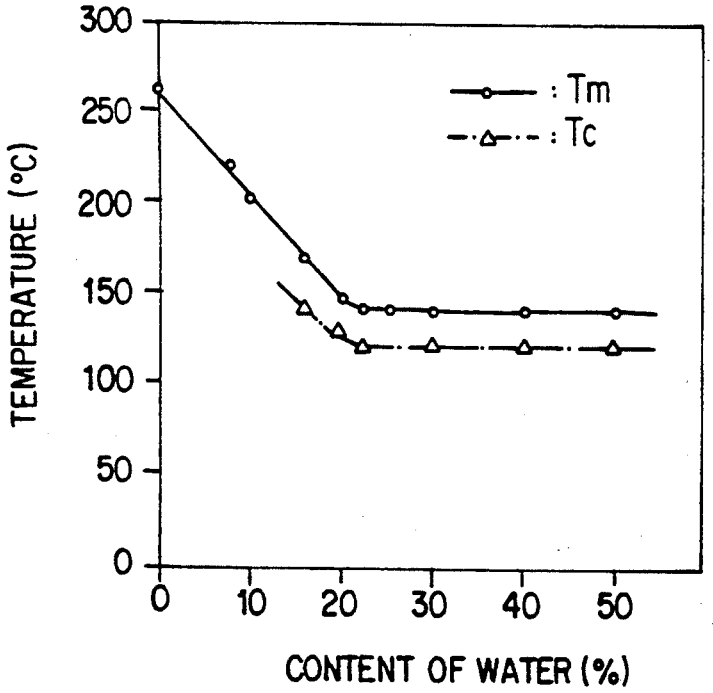
FIG. 2B illustrates an embodiment as shown in FIG. 2A, which exhibits changes in the melting and the solidifying temperatures of an acrylonitirile polymer hydrate containing 89.2% by weight of acrylonitrile and 10.8% by weight of methylacrylate, depending on the water content.
Figure 3:
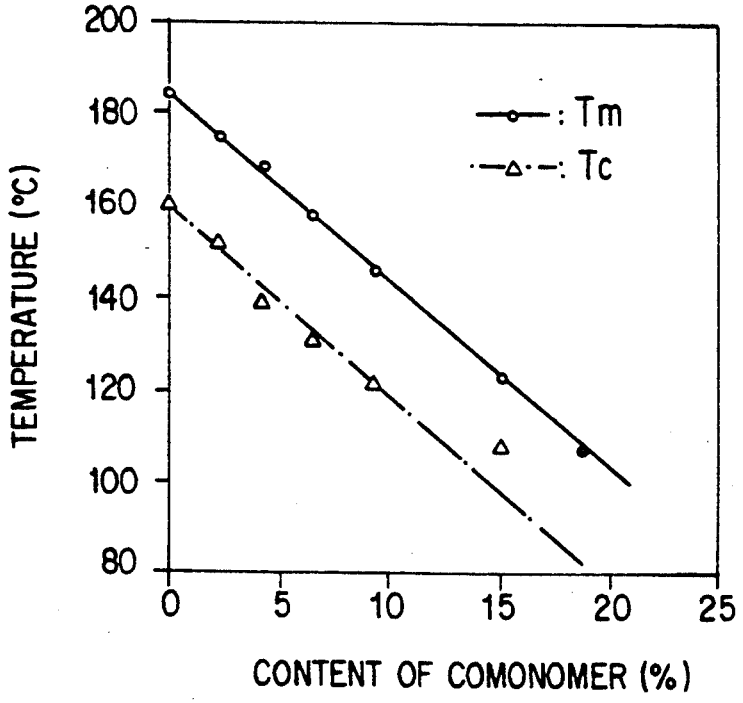
FIG. 3 is a graph illustrating changes in the melting and the solidifying temperatures of an acrylonitrile polymer hydrate, depending on the content of methylacrylate as a comonomer, from which it can be seen that as the methylacrylate content in the acrylonitrile polymer increases, the melting and the solidifying temperatures of the acrylonitrile polymer hydrate are lowered.

FIG. 2A is a diagram illustrating the change of the temperature region in which the melted metacrystalline phase is formed, depending on the water content. FIG. 3 illustrates an embodiment showing the change of the temperature region, depending on the composition of PAN. FIGS. 1B and 2B are embodiments of FIGS. 1A and 2A, respectively, and illustrate the change of the temperature region in which the melted metacrystalline phase is formed, depending on the water content, wherein FIG. 1B is the case in which 20% by weight of water is mixed with PAN containing 89.2% by weight of acrylonitrile and 10.8% by weight of metacrylate and FIG. 2B is the case in which the same PAN as in FIG. 1B is used, but the amount of water to be mixed with PAN is changed within the rang of 5% to 50% by weight.

Figure 4:
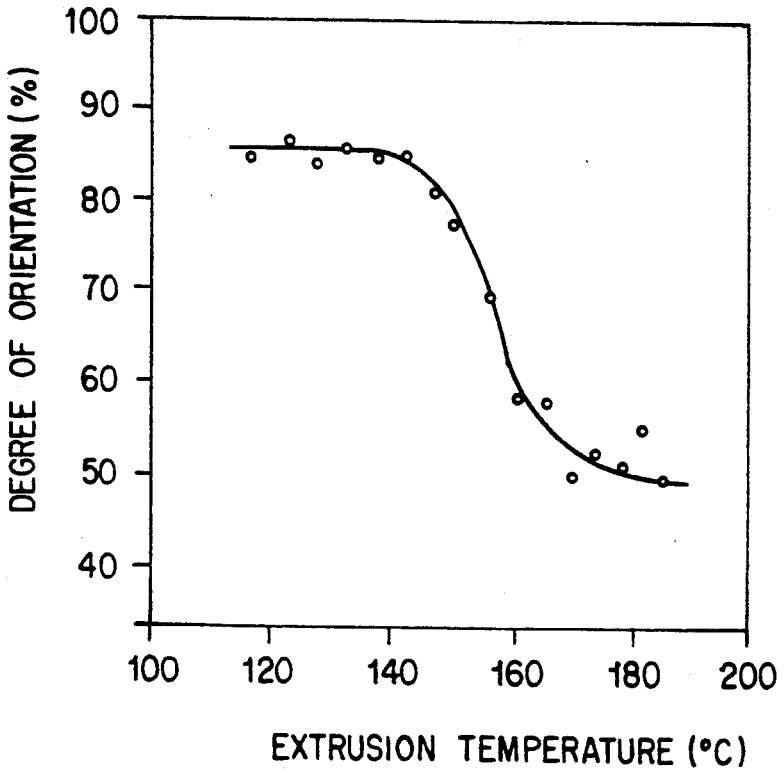
FIG. 4 is a graph illustrating a change in the degree of orientation of the extrudate formed by extruding the melt of an acrylonitrile polymer hydrate, depending on the extrusion temperature of the melt, from which it can be seen that in the temperature range in which an amorphous melt is formed, a scarcely oriented extrudate is obtained, i.e., the degree of orientation acquired is about 50%, while in the temperature range in which a metacrystalline phase is formed, the extrudate having a high molecular orientation degree is obtained, i.e., the degree of orientation acquired is higher than 80%.

When a hydrate formed by addition of an appropriate amount of water to PAN is placed in a pressure-resistant container and then heated to a temperature above its melting temperature, polymers are associated with water molecules to form a PAN/$H_2O$ melt, while autogeneous water vapor pressure is generated. While heating the hydrate, an inert gas, such as nitrogen or argon, may be introduced into the container to maintain it in a pressurized state. The heating temperature must reach the melting temperature (Tm) or higher as indicated in FIG. 1A. The resulting melt is a random, amorphous fluid. If the amorphous melt is cooled to and maintained at a temperature between the melting and the solidifying temperatures of the melt as indicated in FIG. 2A, a supercooled melt of the metacrystalline phase having physical properties similar to those of a liquid crystal is formed. It is believed that the melted metacrystalline phase is a kind of the supercooled melt which exists in the form of a fluid without being solidified even below the melting temperature and has not a random amorphous phase but a regular phase having a molecular order. It appears that in the regular phase the extended PAN molecular chains are arranged in parallel with each other by means of their interaction with water molecules. The regular phase has a self-molecular orientation characteristic as can be seen in a liquid crystal. That is, as shown in FIG. 4, if the extrusion is carried out at an elevated temperature at which an amorphous melt is formed, substantially non-oriented extrudates having the orientation degree of about below 50% are formed. While, if the extrusion is carried out at the lower temperature at which the melted metacrystalline phase is formed, a high orientation degree of about above 80% is accomplished under the same extrusion conditions.

The temperature range in which the melted metacrystalline phase having a molecular order can be formed depends on the acrylonitrile content in PAN, as seen in FIG. 3, or the water content in hydrate, as seen in FIG. 2A. However, resides always between the melting and the solidifying temperatures of the melt, as indicated in FIG. 1A. While the PAN/$H_2O$ melt is being formed, the pressure applied to a pressure-resistant container may be the water vapor pressure which is spontaneously generated depending on the relevant temperature, or the container may be pressurized at a pressure of 1 to 50 atm. The water content in the melt is preferably in the range of 5% to 100%, more preferably 10% to 50% by weight.

Since in the random, amorphous PAN/$H_2O$ melt, the individual molecular chains move more freely, they are irregularly conglomerated and, thus, the molecules fail to establish molecular order. If the amorphous melt is cooled to and maintained within the proper temperature range, the individual molecular chains are subject to inhibition and restriction in their movements due to the intermolecular attraction existing between the PAN molecular chains and the water molecules; thereby they form a extended chain conformation and are arranged orderly in parallel with adjacent molecular chains to form the melted metacrystalline phase, in which the mutual distance between molecules is maintained constantly.

Figure 5A:
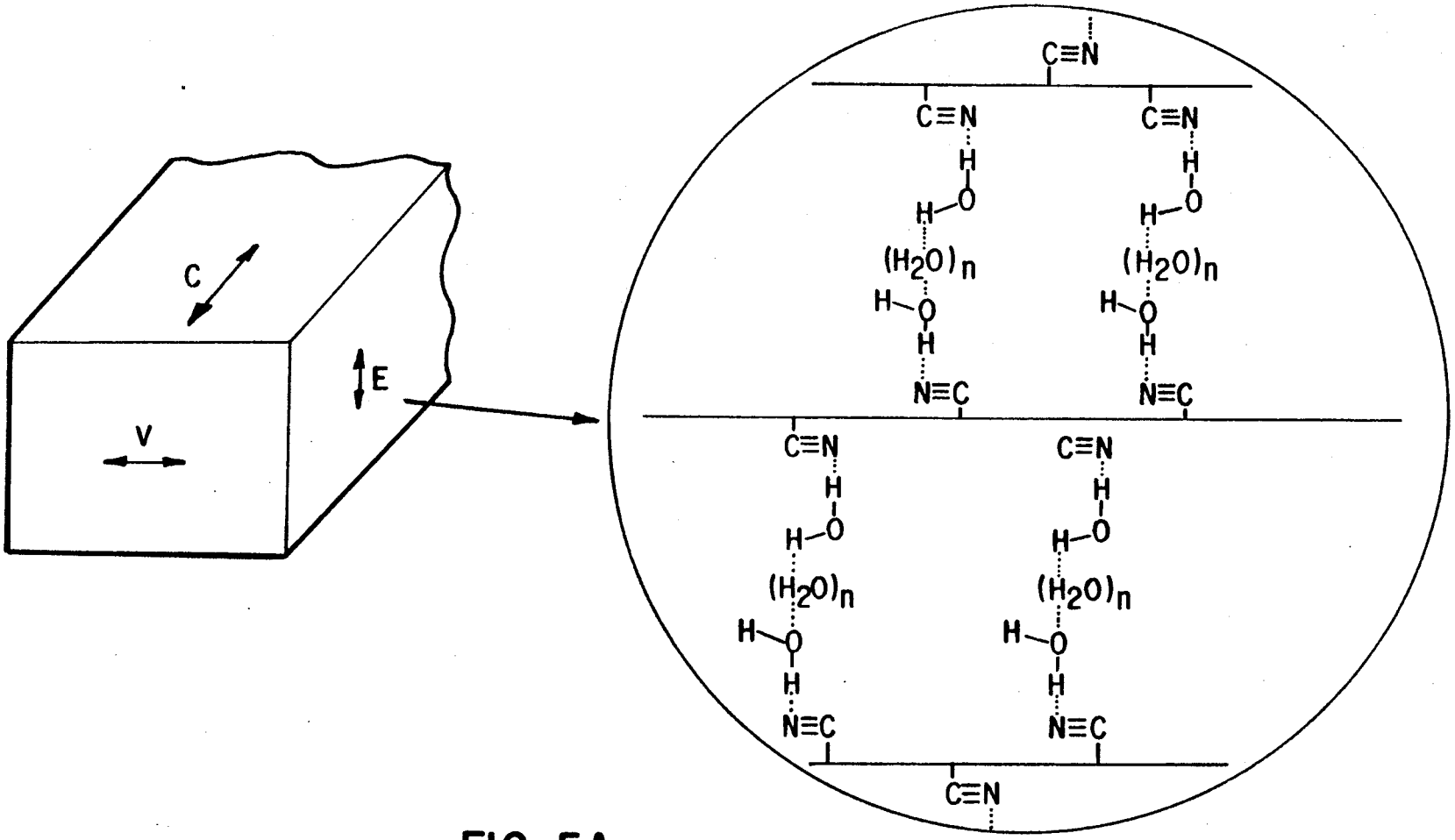
FIG. 5A illustrates a structural model showing a three-dimensional molecular order of an acrylonitrile polymer hydrate formed by interaction of acrylonitrile polymer chains with water molecules when the acrylonitrile polymer hydrate of the metacrystalline phase is extruded in a melted state.
Figure 5B:
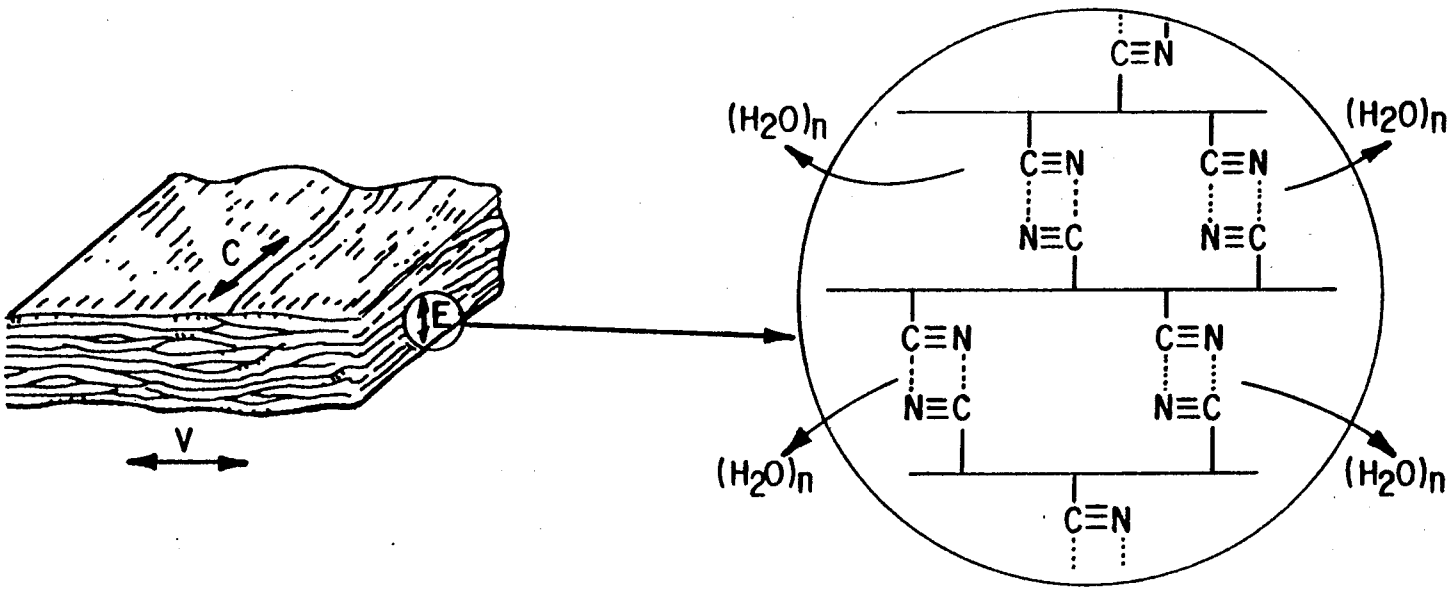
FIG. 5B illustrates another structural model of an acrylonitrile polymer hydrate showing that in fibers formed after extrusion followed by solidification, the acrylonitrile polymer chains form platen fibrils in an extended chain conformation, which show that polymer chains are extended in the arrow "C" direction and the van der Waals force acts on weakly in the arrow "V" direction, while after water is drained away from the melted metacrystalline phase and thereby the phase is shrinked to form fibers, a dipole attraction between nitrile groups acts on in the arrow "D" direction on behalf of the hydrogen bonding force which acts on in the arrow "H" direction in the melted metacrystalline phase.

In the melted metacrystalline phase thus formed, the PAN molecular chains maintain their molecular order and, thus, have difficulty in moving independently. However, it appears that when the whole molecular chains which have been formed in a regular phase move in a selected direction, the PAN molecular chains are easy to have a three-dimentional orientation structure, as can be seen from FIG. 5A. Thus, it is easy to arrange the extended molecular chains of the melted metacrystalline phase having a molecular order in the selected direction and solidify them, as shown in FIG. 5B. That is, fibers having a high molecular orientation degree are easily produced from a melt of the melted metacrystalline phase. On the other hand, since in the amorphous melt the individual PAN molecular chains move independently and freely, the order cannot be created between the molecular chains. Therefore, the molecular chains are freely wrinkled and are in existence as they are conglomerated. Accordingly, it is impossible to arrange the molecular chains in a selected direction.

Since the supercooled melt of the metacrystalline phase according to the present invention has a self-molecular orienting property as can be seen in a liquid crystal, the PAN molecular chains can form a fiber structure of high orientation degree and highly-oriented extrudates having a cross-sectional structure in which platen fibrils are laminated in such a manner that the dehydraion space is retained between the platen fibrils is formed even by a simple extrusion process using a piston-type extruder.

In place of the piston-type extruder, a screw extruder may be used as an extruder. A slit die, a tube die or an arc-type die may be employed as an extrusion die. The ratio of thickness to length of the extrusion die is one or more. The larger ratio is effective in obtaining high orientation. Extrusion temperature is maintained at a constant temperature between the melting and the solidifying temperatures of the PAN hydrate involved. Extrusion conditions are controlled so that the internal pressure of an extruder is maintained at least at the autogeneous water vapor pressure so as to extrude the melt into the atmosphere having room temperature and under normal pressure at an output rate of 1 mm/sec or more and to take-up the resulting continuous extrudates at a linear rate above the output rate. The ratio of the output rate to the take-up rate is one or more. The higher ratio is advantageous in improving the orientation degree.

In addition, in order to produce extrudates having a compact structure, the mechanical properties of which are more improved, it is effective to employ a process which comprises repressing the space through which water is drained off. The repression can be accomplished by a pressure generated by passing the extrudates through a perpendicularly disposed tube, which is charged with a melted metal of an easily melting alloy having a low melting point and a high specific gravity, and which is connected to the extrusion die. The length of the perpendicular tube is controlled depending on the required pressure. The easily melting alloy for charging the perpendicular tube includes the alloys having a melting point of 100° C. below, such as Bi(50%)/Pb(31%)/Sn(19%) and Bi(50%)Pb (24%)/Sn(14%)/Cd(12%).

Figure 6:
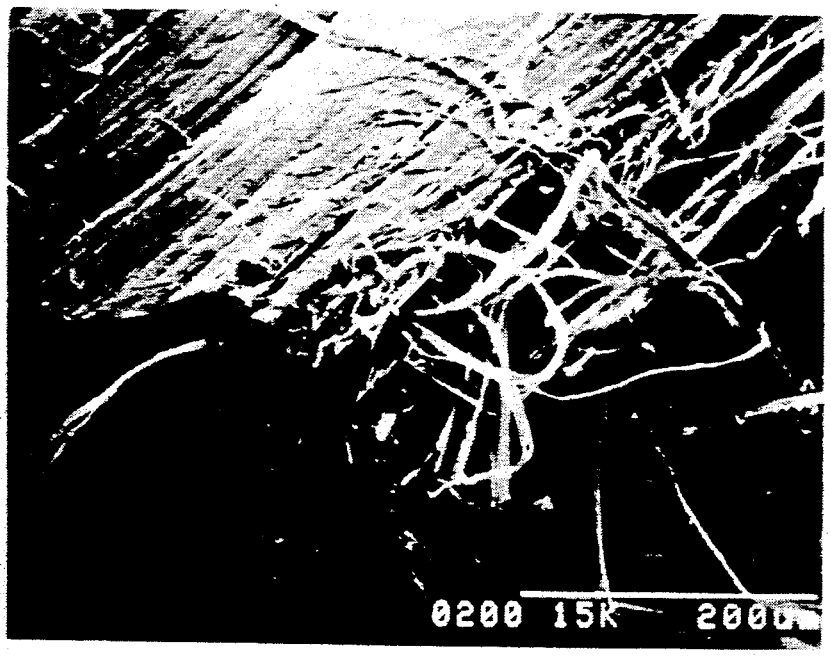
FIG. 6 is a scanning electron photomicrograph of the cross-section and the longitudinal section of the obtained tape-shaped extrudate, taken after fibers have been formed by extruding the metacrystalline phase, which shows that the extrudate has a sectional structure on the cross-section in which platen fibrils are laminated in such a manner that the space from which water has been evaporated out (the "dehydration space") is retained between the platen fibrils, and an internal structure on the longitudinal section in which individual fibrils are redivided into microfibrils to form a fibrous structure.
Figure 7:
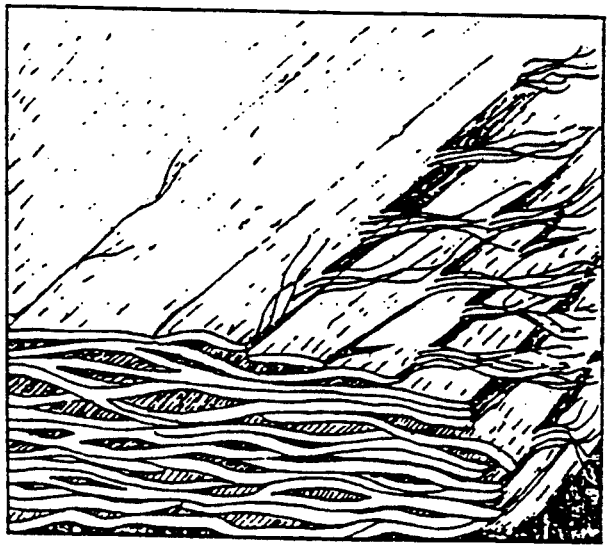
FIG. 7 illustrates a model of the cross-sectional and longitudinal section structure of the tape-shaped extrudate as shown in FIG. 6, from which it can be seen that the extrudate has a sectional structure on the cross-section, in which platen fibrils are laminated at proper intervals, in such a manner that the dehydration space is retained between the platen fibrils and an internal structure on the longitudinal section showing that the individual platen fibrils consist of numerous microfibrils and that fibrils and microfibrils are easily divided into their individuals to form separate fibers.

As described above, extrusion of the melted metacrystalline phase followed by solidification of the resulting extrudates provides tape-shaped extrudates consisting of microfiber bundles and having a sectional structure on the cross-section, in which platen fibrils are arranged and laminated in such a manner that the dehydration space is retained between the platen fibrils, and an internal structure on the longitudinal section, from which it can be seen that the individual fibrils are divided into microfibrils to form fibers, as illustrated in FIG. 6.

Figure 8:
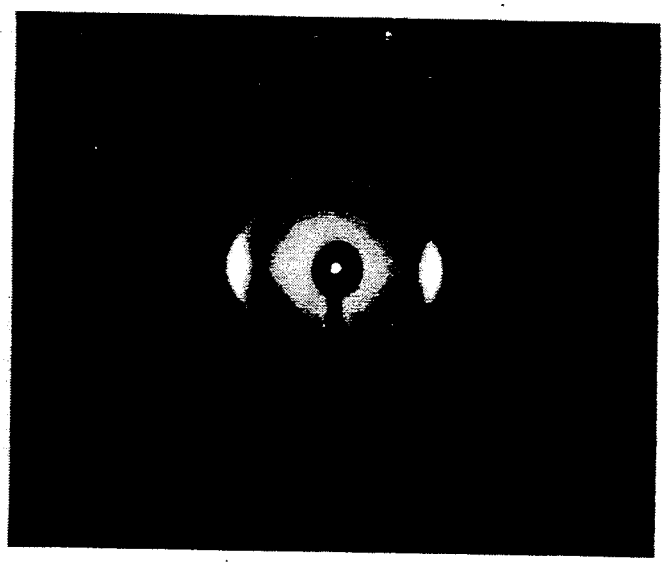
FIG. 8 illustrates an X-ray diffration pattern photograph of the tape-shaped extrudate as shown in FIG. 6, which shows that the fibrous crystal and the highly-oriented structures are formed in the extrudate.

The platen fibrils have a thickness of 1 μm to 10 μm and are made up of microfibrils which have a thickness of 0.01 um to 1.0 um and are clustered tightly to form a fibril. From X-ray diffraction patterns of the tape-shaped extrudates, it is possible to identify that the fibrils and the microfibrils each are in the form of the fibrous crystal and highly-oriented structure, as can be seen from FIG. 8.

Figure 9:
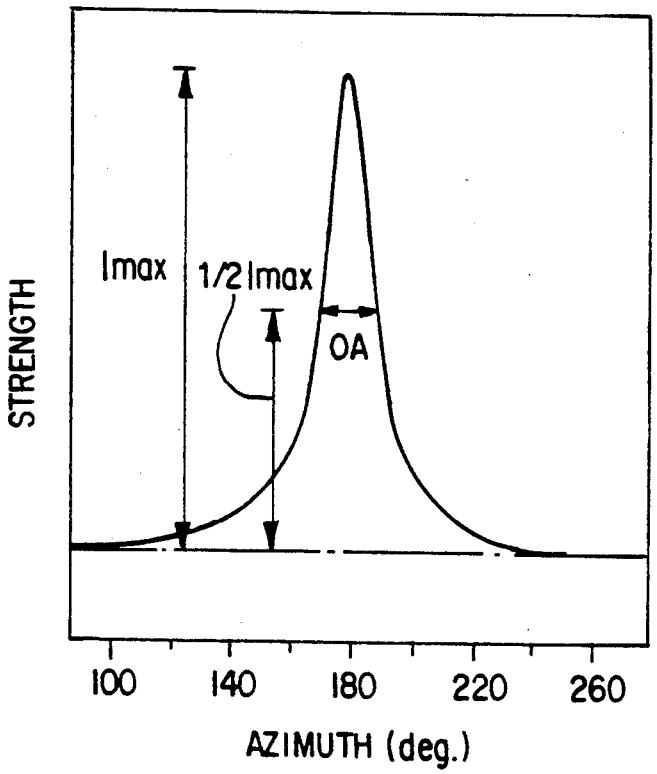
FIG. 9 illustrates an azimuthal scan of the main equatorial peak ($2\theta = 16.2°$) on the X-ray diffraction pattern as shown in in FIG. 8, from which it can be seen that high molecular orientation is formed.

The orientation degree is a value calculated from the half-maximum width (OA) according to the following equation:

$$\text{Orientation Degree (\%)} = \frac{180 - OA}{180} \times 100$$

wherein OA is the peak width at the one half value of the diffraction strength as scanned in the azimuthal direction at the peak position ($2\theta = 16.2°$) of the main diffraction appeared in the direction of the equator on the diffraction pattern, as in FIG. 9. The orientation degree of the extrudates according to the invention is above 70%.

In order to improve the orientation degree, the continuous extrudates thus prepared may be passed in a tensioned state through a high temperature roller, which is under a high-temperature, gaseous atmosphere maintained at a temperature of 100° C. to 220° C., or to which compressive forces are applied, for the heat treatment of the extrudates. The high-temperature, gaseous atmosphere is made up of the gases which scarcely react chemically with PAN, such as water vapor, air, nitrogen, argon, and the like. The preferred range of the heat-treatment temperature is from 120° C. to 200° C. After the heat treatment, draw effects of 5% to 100% to the original length is obtained, and a mechanical strength is improved as well as extrudates made up of well-developed fibrils are prepared. The heat-treated, continuous extrudates are analyzed based on X-ray diffraction pattern in the same manner as stated hereinbefore. The results show that the orientation degree of the extrudates has been high improved as compared that before heat treatment, and both the tensile strength and the modulus of elasticity of the extrudates have also been improved through the heat treatment.

Figure 10:
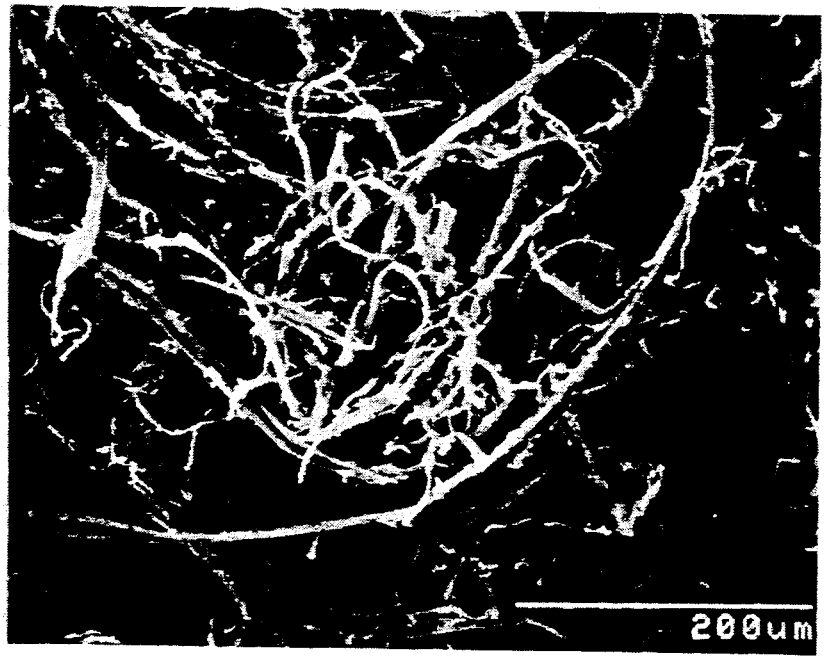
FIG. 10 is a scanning electron photomicrograph of pulp-like short fibers produced by cutting heat-treated, tape-shaped extrudates into an appropriate length followed by beating, which shows that the individual fibers consist of fibrils and microfibrils, and has an irregular section and several crevices and branches in the side.

Cutting followed by beating the heat-treated, continuous extrudates into a random length provides pulp-like short fibers as illustrated in FIG. 10. The size of the resulting short fibers varies depending on the cutting and beating conditions. The pulp-like short fibers thus produced are made up of platen fibrils and microfibrils, both of which have a highly-oriented fiber structure. Short fibers have generally a cross-section in the form of an irregular prolonged ellipse and numerous crevices and branches in the side. The short fibers have the thickness distribution of 0.1 μm to 100 μm and the length distribution of 0.1 mm to 100 mm. The individual fibers are made up of platen fibrils having a thickness of 1 μm to 10 μm and microfibrils having a thickness of 0.01 μm to 1.0 μm. The fine structure of the pulp-like short fibers can be identified by an electron diffraction pattern derived from transmission electron microscope (TEM). The results show that the pulp-like short fibers exhibit the fibrous crystal and the highly-oriented structures, as in the tape-shaped extrudates before beating.

According to the invention, highly-oriented, pulp-like acrylic short fibers are produced by a simple, epoch-making process comprising melting PAN hydrate containing small amount of water as a comelting material, and then extruding the resulting melt followed by heat treating. Thus, costs of production are greatly reduced as compared with conventional processes and the pollution problem is solved of itself as well as short fibers produced per se have a structural feature consisting of highly-oriented fibrils.

As for performance of the short fibers according to the invention, physical properties are superier due to the high molecular orientation. The short fibers of the invention also consist of innumerable microfibrils and, thus, the surface area thereof is very large. The short fibers according to the invention also have an irregular sectional structure and, thus, its binding property with other materials is extremely enhanced.

As mentioned above, the pulp-like short fibers of the invention have optimum requirements as a pulp material. Particularly, since the pulp-like short fibers are produced at very low cost by the simple process, they can be used without difficulty even as a paper raw material on behalf of natural pulp. Further, since the pulp-like short fibers consist of fine fibrils, and have an irregular prolonged oval section and numerous crevices and branches in the side, they have satisfactory characteristics as pulp to be used in paper-making.

DESCRIPTION OF THE PREFERRED EMBODIMENT

The invention will be illustrated in greater detail by way of the following examples. The examples are presented for illustrative purposes and should not be construed as limiting the invention which is properly delineated in the claims.

EXAMPLE 1

A mixture of 22 g of water and 100 g of an acrylonitrile copolymer having a chemical composition consisting of 92.8 % of acrylonitrile and 7.2% of methylacrylate and a viscosity average molecular weight of 102,000 was compressed and placed into a cylinder of an extruder equipped with the cylinder, a piston and a slit die and being able to be sealed. The mixture was heated to 175° C. at applied pressure of 5 kg/cm$^2$ to form a complete melt. Then, the temperature of the extruder was reduced to 148° C. Maintaining this temperature, the melt was pressurized to 60 kg/cm$^2$ by operating the pistion and extruded through the slit die having 0.25 mm/20 mm/3 mm in thickness/width/length into the atmosphere at room temperature and normal pressure to produce continuous, tape-shaped extrudates. The extrudates were taken up onto a roller at a rate of 2 m/min. The structure of the produced extrudates was obserbed by a scanning electron microscope. The result showed that the extrudates had a sectional structure in which platen fibrils having a thickness of 1 μm to 10 μm were uniformly laminated in the sides of the dehydration space, and an internal structure in which the individual fibrils were divided into innumerable microfibrils having a thickness of 0.01 μm to 1.0 μm. According to an X-ray diffraction analysis, it was found that the tape-shaped extrudates had a fibrous crystal structure and the degree of orientation of 89%. The continuous tape-shaped extrudates were divided into the direction of length to form long and fine fibers. Mechanical properties of the resulting fibers were measured. The results were as follows: tensile strength, 4.5 g/denier; elongation, 11%; and tensile modulus, 67 g/denier.

These tape-shaped, continuous extrudates were passed under tension through a roller at 150° C. Compressive forces were added to the extrudates to subject them to drawing of 30% and heat treatment. According to the X-ray analysis, it was found that the drawn and heat-treated extrudates had a fibrous crystal structure and a molecular orientation degree of 91%. The drawn and heat-treated, continuous, tape-haped extrudates were divided into in the direction of length to give long and fine fibers. Mechanical properties of the resulting fibers were measured. The results were as follows: tensile strength, 5.7 g/denier; elongation, 10%; and tensile modulus, 86 g/denier.

The drawn and heat-treated, tape-shaped, continuous extrudates were cut into 20 mm in length and beated using a beater to produce pulp-like short fibers. It was proved that the produced short fibers possessed a thickness distribution of 0.1 μm to 20 μm and a length distribution of 1 mm to 20 mm.

EXAMPLE 2

A mixture of 30 g of water and 100 g of an acrylonitrile homopolymer having a viscosity average molecular weight of 93,000 was compressed and placed into a cylinder of an extruder equipped with the cylinder, a piston and a slit die and being able to be sealed. The mixture was heated to 205° C. at applied pressure of 5 kg/cm$^2$ to form a complete melt. Then, the temperature of the extruder was reduced to 178° C. Maintaining this temperature, the melt was pressurized to 70 kg/cm$^2$ by operating the pistion and extruded through the slit die having 0.35 mm/20 mm/4 mm in thickness/width/length into the atmosphere at room temperature and normal pressure to produce continuous tape-shaped extrudates. The resulting extrudates were taken up at a rate of 1.5 m/min. These continuous extrudates were passed under tension through a roller maintained at 170° C. Compressive forces were applied to the extrudates in order to subject them to drawing of 25% and heat treatment. According to an X-ray diffraction analysis, it was found that the drawn and heat-treated extrudates had a fibrous crystal structure and an orientation degree of 90%. The drawn and heat-treated, continuous, tape-shaped extrudates were divided into the direction of length to form long and fine fibers. Mechanical properties of the resulting long and fine fibers were measured. The results were as follows: tensile strength, 6.0 g/denier; elongation, 9%; and tensile modulus, 93 g/denier.

The drawn and heat-treated, continuous, tape-shaped extrudates were cut into 15 mm in length, followed by beating using a beater to produce pulp-like short fibers. The short fibers thus produced possessed a thickness distribution of 0.1 μm to 20 μm and a length distribution of 1 mm to 15 mm.

EXAMPLE 3

A mixture of 25 g of water and 100 g of an acrylonitrile copolymer having a chemical composition consisting of 94.2% of acrylonitrile and 5.8% of methylacrylate and a viscosity average molecular weight of 178,000 was compressed and placed into a cylinder of an extruder equipped with the cylinder, a piston and a slit die and being able to be sealed. The mixture was heated to 180° C. at applied pressure of 5 kg/cm$^2$ to form a complete melt. Then, the temperature of the extuder was reduced to 155° C. Maintaining this temperature, the melt was pressurized to 60 kg/cm$^2$ by operating the pistion and extruded through the slit die having 0.25 mm/20 mm/3 mm in thickness/width/length to produce continuous tape-shaped extrudates. The resulting extrudates were taken up at a rate of 2 m/min. These continuous extrudates were passed under tension through a roller maintained at 160° C. Compressive forces were applied to the extrudates to subject them to drawing of 25% and heat treatment. According to an X-ray diffraction analysis, the drawn and heat-treated, tape-shaped extrudates had a fibrous crystal structure and an orientation degree of 91%. The tape-shaped extudates were divided into the direction of length to form long and fine fibers. Mechanical properties of the resulting long fibers were measured. The results were as follows: tensile strength, 6.1 g/dinier; elongation, 10%; and tensile modulus, 97 g/denier.

The drawn and heat-treated, continuous, tape-shaped extrudates were cut into 20 mm in length, followed by beating using a beater to produce pulp-like short fibers. The produced short fibers possessed a thickness distribution of 0.1 μm to 20 μm and a length distribution of 1 mm to 20 mm.

EXAMPLE 4

A mixture of 25 g of water and 100 g of an acrylonitrile copolymer having a chemical composition consisting of 88.6% of acrylonitrile and 11.4% of methylacrylate and a viscosity average molecular weight of 215,000 was compressed and placed into a cylinder of an extruder equipped with the cylinder, a piston and a slit die and being able to be sealed. The mixture was heated to 175° C. at applied pressure of 5 kg/cm$^2$ to form a complete melt. Then, the temperature of the extruder was reduced to 145° C. Maintaining this temperature, the melt was extruded through the slit die having 0.40 mm/20 mm/4 mm in thickness/width/length to produce continuous tape-shaped extrudates. The resulting extrudates were taken up at a rate of 1 m/min. These continuous extrudates were passed under tension through a roller maintained at 140° C. Compressive forces were applied to the extrudates to subject them to drawing of 35% and heat treatment. According to an X-ray diffraction analysis, it was found that the drawn and heat-treated, tape-shaped extrudates had a fibrous crystal structure and an orientation degree of 89%. These drawn and heat-treated, continuous, tape-shaped extrudates were divided into the direction of length to form long and fine fibers. Mechanical properties of the resulting long fibers were measured. The results were as follows: tensile strength, 6.3 g/denier; elongation, 10%; and tensile modulus, 84 g/denier.

The drawn and heat-treated, continuous, tape-shaped extrudates were cut into 10 mm in length, followed by beating using a beater to produce pulp-like short fibers. The short fibers thus produced possessed a thickness distribution of 0.1 μm to 30 μm and a length distribution of 1 mm to 10 mm.

EXAMPLE 5

A mixture of 26 g of water and 100 g of an acrylonitrile copolymer having a chemical composition consisting of 94.8% of acrylonitrile and 5.2% of vinylacetate and a viscosity average molecular weight of 97,000 was compressed and placed into a cylinder of an extruder equipped with the cylinder, a piston and a slit die and being ale to be sealed. The mixture was heated to 180° C. at applied pressure of 5 kg/cm$^2$ to form a complete melt. Then, the temperature of the extruder was reduced to 155° C. Maintaining this temperature, the melt was pressurized to 65 kg/cm$^2$ by operating the piston and extruded through the slit die having 0.30 mm/15 mm/4 mm in thickness/width/length to produce continuous, tape-shaped extrudates. The resulting extrudates were taken up at a rate of 1.8 m/min. These continuous extrudates were passed under tension through a roller maintained at 160° C. Compressive forces were applied to the extrudate to subject them to drawing of 27% and heat treatment. According to an X-ray diffraction analysis, it was found that the drawn and heat-treated extrudates had a fibrous crystal structure and an orientation degree of 90%. The drawn and heat treated, continuous, tape-shaped extrudates were divided into in the direction of length to form long and fine fibers. Mechanical properties of the resulting long fibers were measured. The results were as follows: tensile strength, 5.8 g/denier; elongation, 10%; and tensile modulus, 88 g/denier.

The drawn and heat-treated, continuous, tape-shaped extrudates were cut into 10 mm in length, followed by beating using a beater to produce pulp-like short fibers. The short fibers thus produced possessed a thickness distribution of 0.1 μm to 30 μm and a length distribution of 1 mm to 10 mm.

EXAMPLE 6

A mixture of 20 g of water and 100 g of an acrylonitrile copolymer having a chemical composition consisting of 83.8% of acrylonitrile and 16.2% of vinylacetate and a viscosity average molecular weight of 176,000 was compressed and placed into a cylinder of an extruder equipped with the cylinder, a piston and a slit die and being able to be sealed. The mixture was heated to 165° C. at applied pressure of 5 kg/cm$^2$ to form a complete melt. Then, the temperature of the extruder was reduced to 135° C. Maintaining this temperature, the melt was pressurized to 55 kg/cm$^2$ by operating the piston and extruded through the slit die having 0.25 mm/20 mm/3 mm in thickness/width/length to produce continuous tape-shaped extrudates. The extrudates were taken up at a rate of 2.4 m/min. These continuous extrudates were passed under tension through a roller maintained at 140° C. Compressive forces were applied to the extrudates in order to subject them to drawing of 43% and heat treatment. According to an X-ray diffraction analysis, it was found that the drawn and heat-treated, tape-shaped extrudates had a fibrous crystal structure and an orientation degree of 86%. These drawn and heat-treated, continuous, tape-shaped extrudates were divided into the direction of length to form long and fine fibers. Mechanical properties of the resulting long fibers were measured. The results were as follows: tensile strength, 5.3 g/denier; elongation, 12%; and tensile modulus, 72 g/denier.

The drawn and heat-treated, continuous, tape-shaped extrudates were cut into 15 mm in length, followed by beating using a beater to produce pulp-like short fibers. The produced short fibers thus produced possessed a thickness distribution of 0.1 μm to 40 μm and a length distribution of 1 mm to 15 mm.

EXAMPLE 7

A mixture of 21 g of water and 100 g of an acrylonitrile copolymer having a chemical composition consisting of 89.5% of acrylonitrile and 10.5% of styrene and a viscosity average molecular weight of 126,000 was compressed and placed into a cylinder of an extruder equipped with the cylinder, a piston and a slit die and being able to be sealed. The mixture was heated to 170° C. at applied pressure of 5 kg/cm$^2$ to form a complete melt. Then, the temperature of the extruder was reduced to 142° C. Maintaining this temperature, the melt was pressurized to 55 kg/cm$^2$ by operating the piston and extruded through the slit die having 0.3 mm/20 mm/4 mm in thickness/width/length to produce continuous tape-shaped extrudates. The resulting extrudates were taken up at a rate of 2 m/min. These continuous extrudates were passed under tension through a roller maintained at 155° C. Compressive forces were applied to the extrudates to subject them to drawing of 30% and heat treatment. According to an X-ray diffraction analysis, it was found that the drawn and heat-treated, tape-shaped extrudates had a fibrous crystal structure and an orientation degree of 87%. The continuous tape-shaped extrudates were divided into the direction of length to form long and fine fibers. Mechanical properties of the resultig long fibers were measured. The results were as follows: tensile strength, 4.8 g/denier; elongation, 12%; and tensile modulus, 82 g/denier.

EXAMPLE 8

A mixture of 18 g of water and 100 g of an acrylonitrile copolymer having a chemical composition consisting of 87.1% of acrylonitrile and 12.9% of methylacrylate and a viscosity average molecular weight of 112,000 was compressed and placed into a cylinder of an extruder equipped with the cylinder, a piston and a slit die and being able to be sealed. The mixture was heated to 170° C. at applied pressure of 5 kg/cm$^2$ to form a complete melt. Then, the temperature of the extruder was reduced to 140° C. Maintaining this temperature, the melt was pressurized to 50 kg/cm$^2$ by operating the piston and extruded through the slit die having 0.20 mm/20 mm/3 mm in thickness/width/length into an atmosphere at room temperature and normal pressure to produce continuous tape-shaped extrudates. The resulting extrudates were taken up at a rate of 2 m/min. These continuous extrudates were passed under tension through a roller maintained at 145° C. Compressive forces were applied to the extrudates to subject them to drawing of 40% and heat treatment. According to an X-ray diffraction analysis, it was found that the drawn and heat-treated, tape-shaped extrudates were divided into the direction of length to form long and fine fibers. Mechanical properties of the resulting long fibers were measured. The results were as follows: tensile strength, 6.3 g/denier; elongation, 10%; and tensile modulus, 83 g/denier.

COMPARATIVE EXAMPLE 1

For the purpose of a comparison, a mixture of 100 g of an acrylonitrile copolymer having a chemical composition of 92.8% of acrylonitrile and 7.2% of methylacrylate and a viscosity average molecular weight of 102,000 and 22 g of water was compressed and placed into the same extruder as employed in Example and heated to 175° C. at applied pressure of 5 kg/cm$^2$ to form a complete melt. Then, the resulting melt, as it standed, was pressurized to 60 kg/cm$^2$ by operating the piston and extruded through the slit die having 0.25 mm/20 mm/3 mm in thickness/width/length into an atmosphere at room temperature and normal pressure to give continuous extrudates, which were extremely foamed. It was found that the resulting foams did not exhibit any orientation on its X-ray diffraction pattern at all, and it was impossible to produce pulp-like short fibers therefrom.

COMPARATIVE EXAMPLE 2

For the purpose of a comparison, a mixture of 100 g of an acrylonitrile copolymer having a chemical composition of 92.8% of acrylonitrile and 7.2% of methylacrylate and a viscosity average molecular weight of 102,000 and 22 g of water was compressed and placed into the same extruder as employed in Example 1, and heated to 175° C. at applied pressure of 5 kg/cm$^2$ to form a complete melt. Then, the resulting melt, as it standed, was pressurized to 30 kg/cm$^2$ by operating the piston and extruded through the slit die having 0.25 mm/20 mm/3 mm in thickness/width/length into a pressure chamber at room temperature and applied pressure of 2 kg/cm$^2$ to form tape-shaped, continuous extrudates. The extrudates were taken up at a rate of 5 m/min. According to an X-ray diffraction analysis, it was found that the tape-shaped extrudates had an orientation degree of 56%. It was, however, impossible to produce pulp-like short fibers therefrom.

Although the invention has been described with preferred embodiments, it is to be understood that variations and modifications may be employed without departing from the concept of the invention as defined in the following claims.

What is claimed is:

1. A process for the production of pulp-like short fibers having a highly-oriented fibril structure and a thickness distribution of 0.1 μm to 100 μm and a length distribution of 0.1 mm to 100 mm, which comprises:

heating a mixture of an acrylonitirile homopolymer or copolymer having a viscosity average molecular weight of 10,000 to 600,000 and a water content of 5% to 100% by weight based on the acrylonitirile polymer (PAN) to a temperature above a melting temperature of the PAN/$H_2O$ mixture under hermetically sealed conditions to form an amorphous melt, in which the acrylonitrile copolymer consists of acrylonitirile of above 70% by weight and a copolymerizable monomer of below 30% by weight;

cooling the resulting amorphous melt to a temperature below a melting temperature of the PAN/$H_2O$ mixture to obtain a supercooled melt phase;

extruding the resulting supercooled melt into an external atmosphere through a slit die at a temperature between the melting temperature of the PAN/$H_2O$ mixture and a solidifying temperature of the melt to give extrudates having an orientation degree of above 70% on an X-ray diffraction pattern, a fibrous crystal structure, and a sectional structure in which platen fibrils are arranged and laminated in such a manner that the space from which water has been evaporated out during the solidification thereof after the extrusion is retained between the plant fibrils; and passing the resulting extrudates under tension through a high-temperature, gaseous atmosphere maintained at 100° C. to 220° C. or a high-temperature, compressive roller to subject them to drawing and heat treatment, followed by beating mechanically to give the pulp-like short fibers.

2. The process according to claim 1, wherein the highly-oriented fibril structure consists of microfibrils having a thickness of 0.01 μm to 1.0 μm and platen fibrils having a thickness of 1 μm to 10 μm, and has a fibrous crystal structure and the degree of orientation of above 70%.

3. The process according to claim 1, wherein the platen fibrils have a thickness of 1 μm to 10 μm and consist of numerous microfibrils having a thickness of 0.01 μm to 1.0 μm.

4. The process according to claim 1, wherein the drawing and heat treatment is carried out at 120° C. to 200° C.

5. The process according to claim 1, wherein the drawing and heat treatment are accompanied by drawing at a 5% to 100% draw ratio.

6. The process according to claim 1, wherein the high-temperature, gaseous atmosphere is a gas selected from the group consisting of water vapor, air, nitrogen gas, argon gas, and a mixture thereof.

7. The process according to claim 1, wherein the external atmosphere is a gaseous atmosphere having a temperature less than 100° C. and a pressure below 5 atm., an autogeneous water vapor pressure atmosphere having a temperature of 100° C. to 150° C., or a state to which a pressure below 5 atm. is applied by a perpendicular tube which is charged with an easily melting alloy having a melting point less than 100° C.

8. The process according to claim 1, wherein the supercooled melt phase is formed at a temperature between the melting and the solidifying temperatures of the mixture.

9. The process according to claim 1, wherein the PAN/$H_2O$ mixture contains water of 10% to 50% by weight with respect to the polymer.

10. The process for according to claim 1, wherein the amorphous melt is formed at a temperature range between the melting temperature of the mixture and 220° C.

11. The process for according to claim 1, wherein the microfibrils and the platen fibrils each comprise an acrylonitrile homopolymer or copolymer consisting of acrylonitrile of above 70% by weight and a copolymerizable monomer of below 30% by weight and having a viscosity average molecular weight of 10,000 to 600,000.

12. The process according to claim 1 or 11, wherein the acrylonitrile homopolymer or copolymer has a viscosity average molecular weight of 50,000 to 350,000.

13. The process according to claim 1 or 11, wherein the acrylonitrile homopolymer or copolymer comprises an acrylonitrile of above 85% by weight and a copolymerizable monomer of below 15% by weight.

* * * * *